US006796887B2

(12) United States Patent
Marquardt

(10) Patent No.: US 6,796,887 B2
(45) Date of Patent: Sep. 28, 2004

(54) WEAR RING ASSEMBLY

(75) Inventor: David Marquardt, Phoenix, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 10/293,875

(22) Filed: Nov. 13, 2002

(65) Prior Publication Data

US 2004/0092217 A1 May 13, 2004

(51) Int. Cl.[7] ..... B24B 1/00

(52) U.S. Cl. ..... 451/286; 451/398; 451/397; 451/53; 451/59; 451/11

(58) Field of Search ..... 451/285–289, 451/398, 397, 53, 59, 11

(56) References Cited

U.S. PATENT DOCUMENTS

| | | | | |
|---|---|---|---|---|
| 2,965,556 A | | 12/1960 | Damgaard et al. | |
| 3,959,089 A | | 5/1976 | Watis | |
| 4,839,005 A | | 6/1989 | Katsumoto et al. | |
| 5,256,565 A | | 10/1993 | Bernhardt et al. | |
| 5,554,064 A | | 9/1996 | Breivogel et al. | |
| 5,567,300 A | | 10/1996 | Datta et al. | |
| 5,575,706 A | | 11/1996 | Tsai et al. | |
| 5,584,751 A | * | 12/1996 | Kobayashi et al. | 451/288 |
| 5,624,300 A | | 4/1997 | Kishii et al. | |
| 5,637,031 A | | 6/1997 | Chen | |
| 5,807,165 A | | 9/1998 | Uzoh et al. | |
| 5,863,412 A | | 1/1999 | Ichinose et al. | |
| 5,911,619 A | | 6/1999 | Uzoh et al. | |
| 5,993,637 A | | 11/1999 | Hisamatsu et al. | |
| 6,017,437 A | | 1/2000 | Ting et al. | |
| 6,056,869 A | | 5/2000 | Uzoh | |
| 6,068,548 A | * | 5/2000 | Vote et al. | 451/398 |
| 6,077,151 A | * | 6/2000 | Black et al. | 451/53 |
| 6,077,412 A | | 6/2000 | Ting et al. | |
| 6,083,089 A | * | 7/2000 | Breivogel et al. | 451/287 |
| 6,171,467 B1 | | 1/2001 | Weihs et al. | |
| 6,176,992 B1 | | 1/2001 | Talieh | |
| 6,179,694 B1 | * | 1/2001 | Quek | 451/286 |
| 6,299,741 B1 | | 10/2001 | Sun et al. | |
| 6,328,872 B1 | | 12/2001 | Talieh et al. | |
| 6,354,927 B1 | * | 3/2002 | Natalicio | 451/287 |
| 6,435,949 B1 | * | 8/2002 | Katsuoka et al. | 451/59 |
| 6,443,824 B2 | * | 9/2002 | Shendon et al. | 451/288 |
| 6,540,592 B1 | * | 4/2003 | Schultz et al. | 451/285 |
| 6,565,424 B2 | * | 5/2003 | Katagiri et al. | 451/285 |
| 6,579,151 B2 | * | 6/2003 | Tseng et al. | 451/11 |
| 6,607,428 B2 | * | 8/2003 | Tolles | 451/286 |

FOREIGN PATENT DOCUMENTS

| | | |
|---|---|---|
| GB | 2 069 531 | 8/1981 |
| JP | 58137527 | 8/1983 |
| WO | WO 00/26443 | 5/2000 |

OTHER PUBLICATIONS

Robert J. Contolini, Anthony F. Bernhardt and Steven T. Mayer, *Electrochemical Planarization for Multilevel Metallization*, J. Electrochem. Soc., vol. 141, No. 9.

* cited by examiner

*Primary Examiner*—George Nguyen
(74) *Attorney, Agent, or Firm*—Ingrassia Fisher & Lorenz

(57) ABSTRACT

A wear ring assembly is provided for use in a workpiece (e.g. a semiconductor wafer) polishing apparatus. The wear ring assembly comprises a wear element and a backing ring. The backing ring includes a fulcrum and is configured to transfer a component of pressure applied to the backing ring to the wear element via the fulcrum. In this manner, a substantially uniform vertical displacement of the wear ring is achieved.

22 Claims, 3 Drawing Sheets

WEAR RING ASSEMBLY

TECHNICAL FIELD

This invention relates generally to an apparatus for polishing or planarizing a workpiece such as a semiconductor wafer, and more particularly, to a wear ring assembly for use on a polishing or planarizing apparatus that improves the uniformity of polishing and/or planarization.

BACKGROUND OF THE INVENTION

The manufacture of many types of workpieces require the polishing and/or planarization of at least one surface of the workpiece. Examples of such workpieces that require a planar surface include semiconductor wafers, optical blanks, memory disks, and the like. Without loss of generality, but for ease of description and understanding, the following description of the invention will focus on applications to only one specific type of workpiece, namely a semiconductor wafer. The invention, however, is not to be interpreted as being applicable only to semiconductor wafers. Those of skill in the art instead will recognize that the invention can be applied to any generally disk shaped workpieces.

Chemical mechanical polishing (CMP) is a technique which has been conventionally used for the planarization of semiconductor wafers. For example, see U.S. Pat. No. 5,099,614, issued in March in 1992 to Riarai et al; U.S. Pat. No 5,329,732 issued July 1994 to Karlsrud et al, and U.S. Pat. No. 5,498,199 issued March 1996 to Karlsrud et al. Furthermore, chemical mechanical polishing is often used in the formation of microelectriconic devices to provide a substantially smooth, planar surface suitable for subsequent fabrication processes such as photoresist coating and pattern definition. A typical chemical mechanical polishing apparatus suitable for planarizing a semiconductor surface generally includes a wafer carrier head configured to support, guide, and apply pressure to a wafer during the polishing process, a polishing compound such as a slurry to assist in the removal of material from the surface of the wafer, and a polishing surface such as a polishing pad.

A wafer surface is generally polished or planarized by moving the surface of the wafer to be polished relative to the polishing surface in the presence of a polishing compound. In particular, the wafer is placed in a carrier such that the surface to be polished is placed in contact with the polishing surface, and the polishing surface and the wafer are moved relative to each other while slurry is supplied to the polishing surface.

The construction of the carrier head and the relative motion between the polishing pad and the carrier head have been extensively engineered in an attempt to achieve a uniform rate of removal of material across the surface of the workpiece hence to achieve the desired planar surface. For example, the carrier head generally includes a flexible membrane that contacts the back or unpolished surface of the workpiece and accommodates variations in that surface. One or more pressure chambers may be provided behind the membrane so that different pressures can be applied to various locations on the back surface of the workpiece to cause uniform polishing across the front surface of the workpiece. The carrier head also generally includes a wear ring (sometimes referred to as a "retaining ring" or "edge ring" but hereinafter referred to without limitation as a "wear ring") that surrounds the membrane and the workpiece and pre-stresses or pre-compresses the polishing pad to protect the edge of the workpiece. The wear ring, which has an internal diameter (ID) only slightly larger than the diameter of the workpiece, also serves to constrain the workpiece, maintaining the workpiece properly positioned under the carrier head. The polishing pad may move in a linear motion, a rotational motion, or an orbital motion, depending on the type of CMP apparatus being utilized. Additionally, the carrier head, and hence the workpiece, may also be in rotational motion. The relative motion between the carrier head and the polishing pad and the polishing pad itself are designed so as to hopefully provide the same degree of polishing to all areas of the polished side of the wafer. Unfortunately, uniform removal is not always obtained.

A CMP carrier head includes a wear or retaining ring around the periphery thereof forming a pocket or recess which receives and carries the wafer. The wafer-loaded carrier head is lowered and locked in a position such that the wafer is positioned and resides only a small distance above the polishing pad. Fluid pressure (e.g. air) is then applied to a diaphragm or bladder in the carrier head to push the wafer thru the remaining distance or gap between the wafer and the polishing pad and urge the wafer into the polishing pad. Without more, the edge of the wafer would dig into the polishing pad causing excessive polishing as the wafer's edge, sometimes referred to as "edge-bum". Thus, it is desirable that the polishing pad be as flat as possible in region of the wafer's edge. To accomplish this, the wear ring, which positions and maintains the wafer within the carrier head, is also placed into contact with the polishing pad to compress (i.e. flatten) the polishing pad in the vicinity of the edge of the wafer. The wear ring is urged into contact with the polishing pad by means of a second diaphragm or bladder to which a fluid pressure (e.g. air) is applied.

The use of a wear ring for the purpose of flattening the polishing pad in the vicinity of the wafer's edge presents certain challenges. First, if the depth to which the wear ring is pressed into the polishing pad is too low, edge-burn will still occur. If the depth is too high, the edge will be underpolished. In addition, if the material from which the wear ring is made is too soft (e.g. plastic), that portion of the wear ring adjacent the wafer's edge may bend upward since the inner potion of the wear ring is thinner than the outer portion as will be more fully described hereinbelow.

The above described bending can be substantially avoided by using stiffer materials such as ceramic, steel, etc. This however presents a further challenge. Due to the geometry and configuration of existing CMP apparatus, the force applied to the wear ring assembly to urge it into the polishing pad is applied to an outer portion of the wear ring located at some distance from that portion of the wear ring under which the force must be realized (i.e. that region of the polishing pad substantially adjacent the edge of the wafer). Since the applied diaphragm pressure is not in line with that portion of the polishing pad at which the force must be realized, a twisting moment is induced into the wear ring assembly. This moment creates a toroidal deflection of the wear ring assembly, and the outer region of the wear ring exerts more pressure on the polishing pad than that region of the wear ring near its inner diameter (i.e. adjacent the wafer's edge). The result is a loss of polishing control at the edge of the wafer. Furthermore, as the diaphragm pressure is varied, the induced moment is also varied resulting in a further loss of control.

In view of the foregoing, it should be appreciated it would be desirable to provide an improved wear ring assembly which substantially avoids the above referred to problems and improves polishing uniformity.

SUMMARY OF THE INVENTION

According to an aspect of the invention, there is provided a wear ring assembly for use in a workpiece polishing apparatus. The wear ring assembly comprises a wear element and a backing ring. The backing ring includes a fulcrum and is configured to transfer a pressure applied to the backing ring to the wear element via the fulcrum. The wear element is retained by means of a clamp ring coupled to the carrier head of the polishing apparatus.

BRIEF DESCRIPTION OF THE DRAWINGS

The following drawings are illustrative of particular embodiments of the invention and therefore do not limit the scope of the invention, but are presented to assist in providing a proper understanding of the invention. The drawings are not to scale (unless so stated) and are intended for use in conjunction with the explanations in the following detailed description. The present invention will hereinafter be described in conjunction with the appended drawing figures, wherein like numerals and like elements, and.

DETAILED DESCRIPTION OF EXEMPLARY EMBODIMENTS

The following description is exemplary in nature and is not intended to limit the scope, applicability, or configuration of the invention in any way. Rather, the following description provides a convenient illustration for implementing exemplary embodiments of the invention. Various changes to the described embodiments may be made in the function and arrangement of the elements described herein without departing from the scope of the invention.

For purposes of illustration only, the invention will be described in relationship to a chemical mechanical planarization apparatus, although the invention is also applicable to other types of polishing apparatus.

Figure 1:
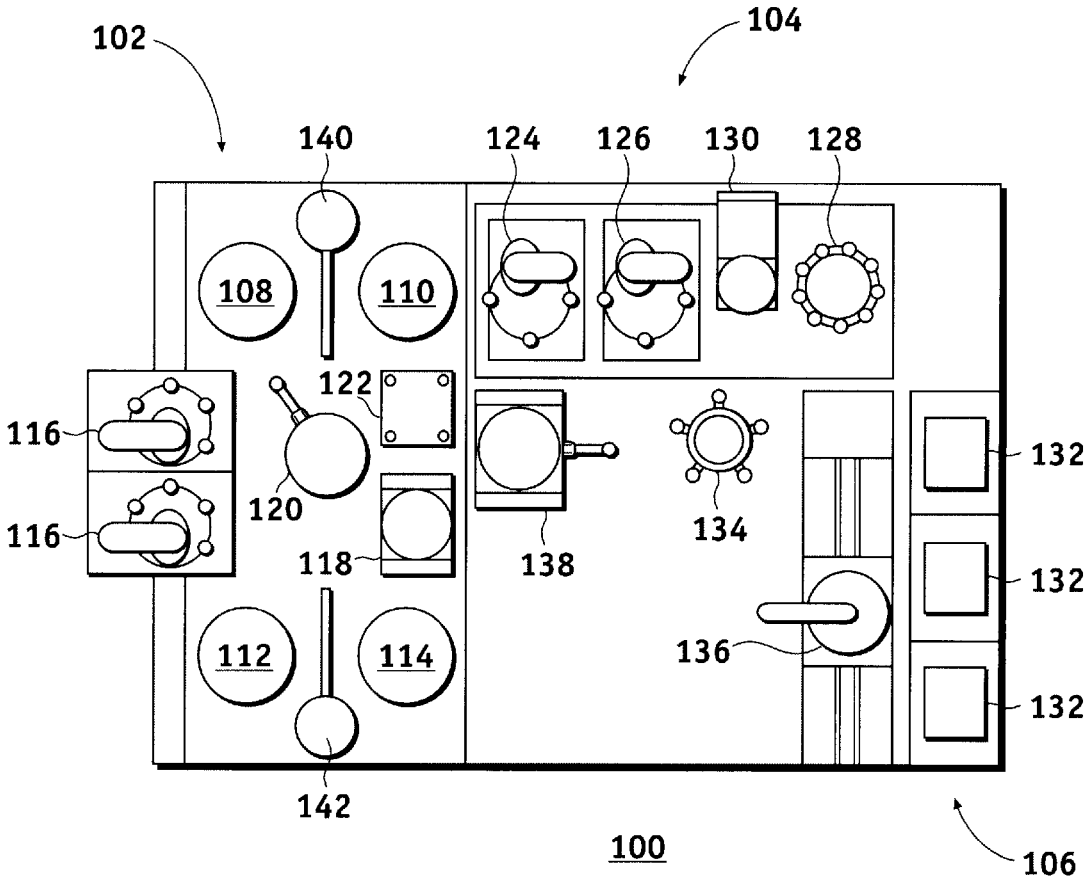
FIG. 1 is a top cutaway view of a wafer processing system capable of incorporating the inventive wear ring assembly.

FIG. 1 illustrates a top cutaway view of the polishing apparatus 100 for processing semiconductor wafers. For example, apparatus 100 is suitable for electrochemically depositing or planarizing conductive material on or from the surface of a workpiece in accordance with the present invention. Apparatus 100 includes a multi-station polishing system 102, a clean system 104, and a wafer load/unload station 106. In addition, apparatus 100 includes a cover (not shown) that surrounds apparatus 100 to isolate apparatus 100 from the surrounding environment. Machine 100 may be a Momentum machine available from SpeedFam-IPEC Corporation of Chandler, Ariz. or may be any machine capable of processing semiconductor wafers.

Although the present invention relates to the cleaning, rinsing, and drying of a variety of workpieces such as magnetic disks, optical disks, and the like, the invention is conveniently described below in connection with rinsing and drying the surface of a semiconductor wafer. In the context of the present invention, the term "wafer" shall mean semiconductor substrates, which may include layers of insulating, semiconductor, and conducting layers or features formed thereon and used to manufacture microelectriconic devices.

Exemplary polishing station 102 includes four polishing stations, 108, 110, 112, and 114, that each operate independently; a buff station 116; a stage 118; a robot 120; and optionally, a metrology station 122. Polishing stations 108–114 may be configured as desired to perform specific functions such as electrochemical planarization, chemical mechanical polishing, and the like.

Polishing system 102 also includes polishing surface conditioners 140 and 142. The configuration of conditioners 140 and 142 generally depend on the type of polishing surface to be conditioned. For example, when the polishing surface comprises a polyurethane polishing pad, conditioners 140 and 142 may include a rigid substrate coated with diamond material. Various other surface conditioners may also be used in accordance with the present invention.

Clean system 104 is generally configured to remove debris such as slurry residue and material from the wafer surface. In accordance with the illustrated embodiment, system 104 includes clean stations 124 and 126, a spin rinse dryer (SRD) 128 and a robot 130 configured to transport the wafer between clean stations 124 and 126 and spin rinse dryer 128. Alternatively, clean station 104 may be separate from the remainder of the apparatus.

Load station 106 is configured to receive dry wafers for processing, but the wafers may remain in a wet (e.g., deionized water) environment until the wafers are transferred to the clean station. In operation, cassettes 132, including one or more wafers, are loaded onto apparatus 100 at station 106. The wafers are then individually transported to a stage 134 using a dry robot 136. A wet robot 138 retrieves a wafer at stage 132 and transports the wafer to metrology station 122 for film characterization or to stage 118 within polishing system 102. Robot 120 picks up the wafer from metrology station 122 or stage 118 and transports the wafer to one of polishing stations 108–114 for electrochemical deposition or planarization. After a desired amount of material has been deposited or removed, the wafer may be transported to another polishing station.

After conductive material has been either deposited or removed from the wafer surface, the wafer is transferred to buff station 116 to further polish the surface of the wafer. After the polishing and/or buff process, the wafer is transferred to stage 118 which is configured to maintain one or more wafers in a wet (e.g. deionized water) environment.

After the wafer is placed in stage 118, robot 138 picks up the wafer and transports it to clean system 104. In particular, robot 138 transports the wafer to robot 130, which in turn places the wafer in one of the clean stations 124 or 126. The wafer is cleaned using one or more stations 124 and 126 and then is transported to spin rinse dryer 128 to rinse and dry the wafer prior to transporting it to load/unload station 106 using robot 136.

Figure 2:
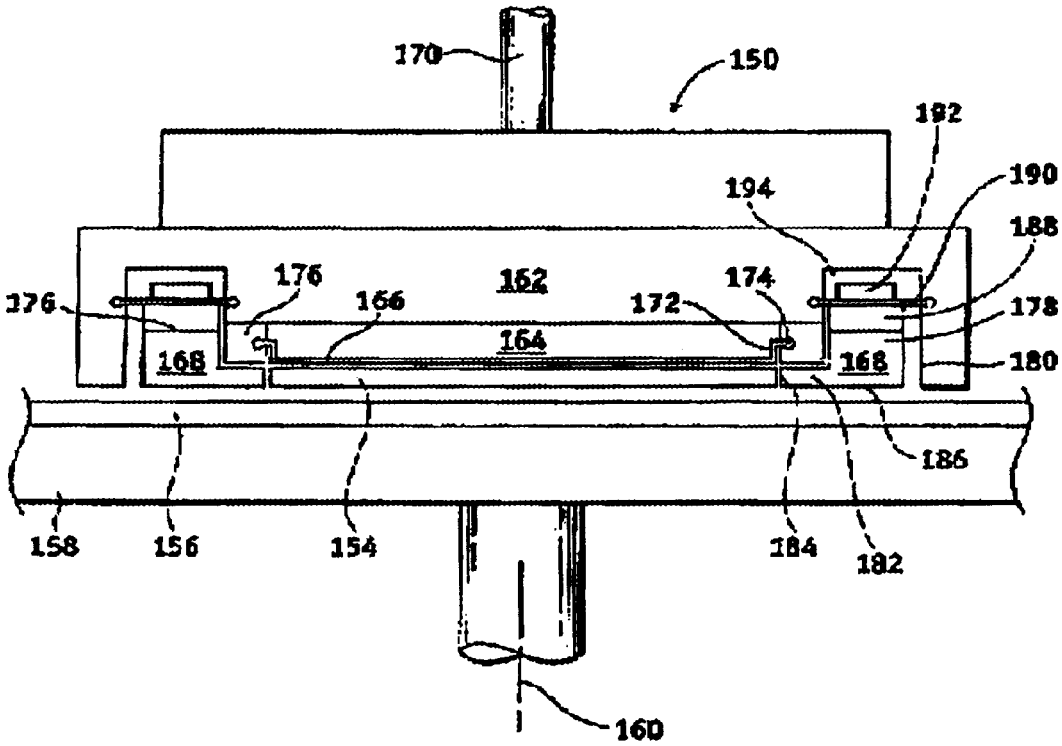
FIG. 2 (PRIOR ART)
FIG. 2 is a cross-sectional view of a polishing apparatus suitable for use in the apparatus shown in FIG. 1.

FIG. 2 illustrates schematically, in cross section, basic elements of a carrier head 150 for one type of CMP apparatus with which a wear ring 152 may be used. The carrier head module controllably presses a workpiece, such as a semiconductor wafer 154, into contact with a polishing pad 156 to planarize the lower surface of the wafer. Polishing pad 156 is supported on a platen 158 which is configured to cause the polishing surface to move. By way of example, lower module 144 may cause the polishing pad 156 to rotate, translate, orbit, or any combination thereof. For example, platen 158 may orbit at a radius of approximately one-quarter inch to one inch about an axis 160 at, for example, 30 to 340 orbits per minute while simultaneously causing platen 158 to dither or partially rotate. In this case, material is removed primarily from the orbital motion of module 158. This allows a relatively constant speed between the wafer surface and the polishing surface to be maintained during a polishing process, and thus material removal rates are maintained relatively constant across the wafer surface.

Polishing machines including orbiting lower modules are additionally advantageous because they require relatively little space when compared to rotational polishing modules. In particular, because a relatively constant velocity between the wafer surface and the polishing surface can be maintained across the wafer surface by moving the polishing surface in an orbital motion, the polishing surface can be about the same size as the surface to be polished. For example, a diameter of a polishing surface may be only 0.5 inches greater than the diameter of the wafer.

Carrier head 150 includes a rigid casing 162 having an annular cavity 164 on a lower surface. A flexible membrane 166 is stretched across the cavity and presses against the upper surface of wafer 154. A toroidal shaped wear ring 168 is attached to the rigid casing with a resilient attachment, to be more fully described below. The wear ring surrounds cavity 164 and serves to precondition the polishing pad and to contain the lateral movement of wafer 154, thus maintaining the wafer in position on the underside of carrier head 150. The wear ring is positioned with its substantially planar lower surface in substantially the same plane as the lower surface of the wafer. Alternatively, the lower surface of the wear ring may be in a plane that is parallel to the plane of the lower surface of wafer 154 but that is slightly displaced in the vertical direction (e.g. by about 0.25 mm or less) from the wafer plane. Rigid casing 162 is attached to a shaft 170 that positions the carrier head and hence wafer 154. Shaft 170 may also be used to impart a rotational motion to the carrier head to improve uniformity of the polishing action.

In a CMP process using a carrier head such as carrier head 150, wafer 154 is pressed into contact with polishing pad 156 in the presence of a polishing slurry. To obtain a uniform pressure across the wafer and thus ideally a uniform material removal rate, pressure is exerted against flexible membrane 166 by pressurized gases or fluids (e.g. air) conveyed to cavity 164. The flexible membrane conforms to the shape of the upper surface of wafer 154 and presses the wafer against the polishing pad. Although only a single cavity 164 is illustrated, multiple cavities and multiple pressures may be used to press the wafer against the polishing pad in an attempt to make the removal rate uniform. The polishing pad may be in rotational, orbital, or linear motion relative to wafer 154, depending on the particular type of CMP apparatus being utilized. Carrier head 150 may also rotate on shaft 170.

Flexible membrane 166 includes a vertical edge portion 172 and an edge bead 174 that is clamped to the rigid casing at the edge of cavity 164 by an annular clamp 176. Because the flexible membrane extends to the edge of wafer 154, the upper surface 176 of wear ring 168 is configured to accommodate clamp 176. Wear ring 168 thus includes a thick portion 178 adjacent an exterior cylindrical surface 180 and a thin portion 182 adjacent an interior cylindrical surface 184. Lower surface 186 is substantially planar. Wear ring 168 may be coupled to a backing 188 plate that is clamped to a flexible wear ring diaphragm 190 by a clamp 192. The wear ring diaphragm provides a bottom seal to a wear ring cavity 194. Vertical positioning of the wear ring relative to the vertical positioning of the wafer to be polished is controlled by pressurized gases or other fluids that are conveyed to wear ring cavity 194. Increasing pressure in the cavity causes flexible wear ring diaphragm 190 to flex, moving wear ring 168 vertically downward. The wear ring can be attached to the wear ring mounting plate by bolts or other conventional fastening means. Of course, other mechanisms, such as springs or the like, may be employed for resilient attachment of the wear ring to the rigid casing of carrier head 150.

Figure 3:
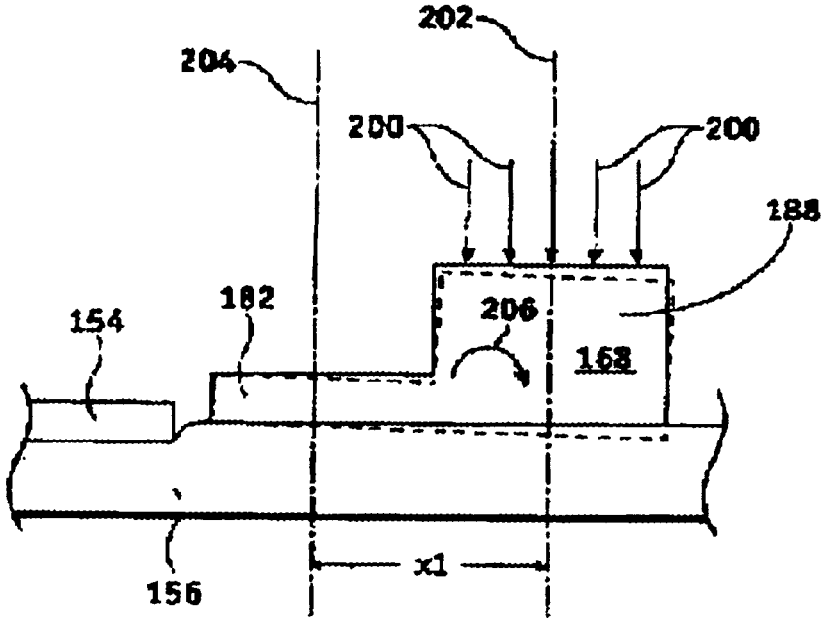
FIG. 3 (PRIOR ART)
FIG. 3 is a cross-sectional view of a portion of the apparatus shown in FIG. 2.

As stated previously, due to the geometry and configuration of existing CMP equipment, the force applied to wear ring 168 is transmitted via diaphragm 190 through backing ring or plate 188 to the thicker portion 178. However, this force must be realized at the thinner portion 182 adjacent wafer 154. Since the applied diaphragm pressure is not in line with that portion of polishing pad 154 at which the force must be realized, a twisting moment is induced creating a toroidal deflection of the wear ring. Thus, thick portion 178 of wear ring 168 exterts more pressure on polishing pad 156 than does thin portion 182 creating a non-uniform pad profile under the wear ring surface and resulting in a loss of polishing control at the wafer's edge. This problem is more clearly illustrates in FIG. 3 where like reference numerals denote like elements. Wear ring 168 is shown just prior to being urged into pad 156 (shown in solid). The pressure exerted by diaphragm 190 (not shown in FIG. 3) is represented by arrows 200 and creates a resultant force that is applied to wear ring 168 downward along line 202. For proper flattening of pad 156 in the region adjacent the edge of wafer 154, the force should be realized along line 204. Therefore, a twisting moment, indicated by arrow 206 and caused by moment arm X1 is induced causing the outer portion of wear ring 168 to compress pad 156 to a greater degree than does the inner portion of wear ring 168 adjacent the edge of wafer 154 as is shown by dotted lines in FIG. 3. Thus, the desired flat polishing pad surface in the vicinity of the wafer's edge has not been achieved.

Figure 4:
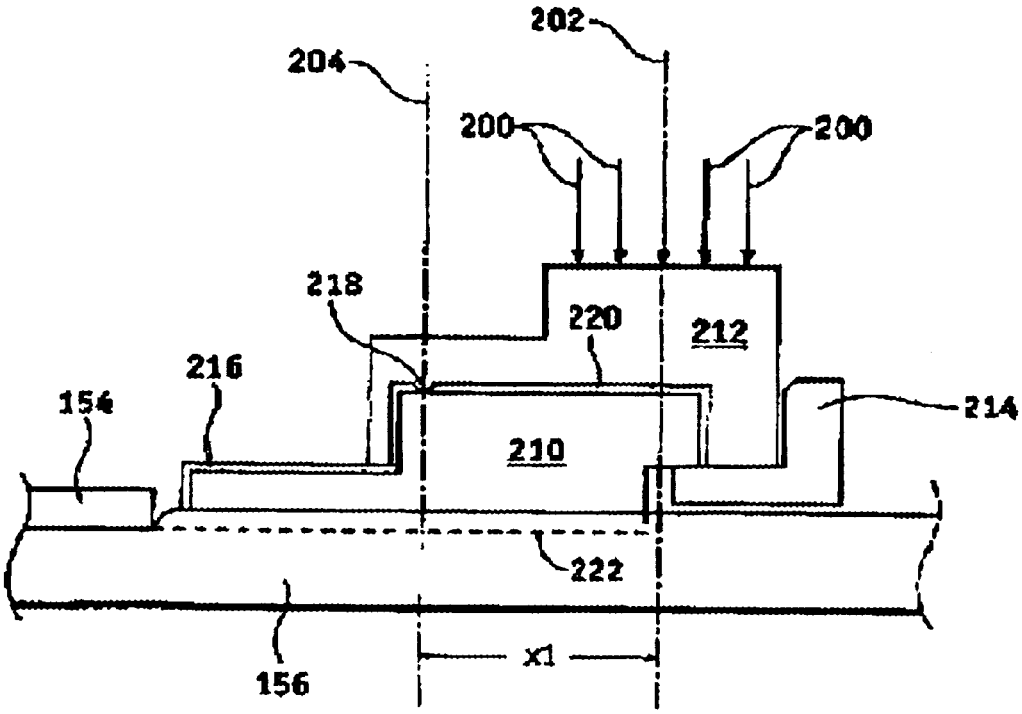
FIG. 4 is a cross-sectional view of a wear ring assembly in accordance with the teachings of the present invention.

FIG. 4 is a cross-sectional view of a wear ring assembly or module in accordance with the present invention. The inventive wear ring assembly comprises a lower member or wear element 210 made of, for example, steel, ceramic, or other material which exhibits the required stiffness, an upper member or backing plate 212, and a clamp ring 214. Annular clamp ring 214 is attached to backing ring or plate 212 as, for example, by welding, bolting, or adhesively and prevents wear elements 210 from falling from the carrier head when the carrier head is lifted. If desired, a protective plastic insert 216 may be utilized on the thinner portion of wear element 210. As was the case in FIG. 3, line 202 represents the centerline of applied force, and line 204 represents the centerline of realized force.

As was the case previously, the resulting diaphragm force is applied downwardly along line 202 while the realized force line 204 is separated from line 202 by a distance X1. However this moment arm does not induce twisting of wear element 210 for the following reasons. The lower surface of backing ring 212 is provided with a fulcrum 218 which contacts an upper surface of wear element 210 at a location which substantially coincides with realized force centerline 204. Ideally, fulcrum 218 represents a point contact in two dimensions and a line contact in three dimensions. Diaphragm pressure (lines 202) is still applied to the top of backing ring 212. However, in this case, the resultant force is applied axially to wear element at its point of contact with fulcrum 218. As diaphram pressure is applied to backing ring 212, backing ring 212 will still deflect toroidally since the applied load is still at a distance X1 from the realized force centerline 204. This induces a moment or twisting of backing ring which is limited by gap 220 and other system constraints. The important thing, however, is that no moment is transferred to wear element 210 as a result of fulcrum 218. Only a vertical component of the diaphragm pressure is transferred from backing ring 212 to wear element 210 through a point contact or fulcrum 218. Wear element 210 suffers no structural distortion as a result of the misalignment between the applied force and realized force centerlines 202 and 204 respectively. As a result, substantially uniform vertical displacement of wear element 210 and a substantially flat polishing pad profile can be achieved adjacent the edge of wafer 154 as is indicated by dotted line 222 when wear element 210 is urged into polishing pad 156.

Thus, it is apparent that there has been provided, in accordance with the invention, a wear ring that can be used in a planarization/polishing operation to achieve uniform polishing across the entire surface of a workpiece. Although the invention has been desribed with reference to various illustrative embodiments, it is not intended that the invention be limited to these illustrative embodiments. Those of skill in the art will recognize that many variations and modifications exist that do not depart from the true spirit of the invention. For example, while the invention has been described with reference to an apparatus for the CMP processing of a semiconductor wafer, the invention is not to be limited to semiconductor wafers or to a CMP process. Rather the invention is applicable to a broad range of workpieces and to a broad range of planarization or polishing processes performed on such workpieces. Accordingly, it is intended to include within the invention all such variations and modifications as fall within the scope of the appended claims.

What is claimed is:

1. A wear ring assembly for use in a workpiece polishing apparatus, said assembly comprising:

a wear element; and a backing ring having fulcrum thereon and configured to transfer a pressure applied to said backing ring to said wear element via said fulcrum.

2. An assembly according to claim 1 further comprising a clamp ring coupled to said polishing apparatus for retaining said wear element.

3. An assembly according to claim 1 wherein said wear element and said backing ring are separate and engage each other only via said fulcrum.

4. An assembly according to claim 3 wherein said wear element is toroidal in shape having a first section and a second thicker section.

5. An assembly according to claim 4 wherein said pressure is applied via said fulcrum to said second thicker section.

6. An assembly according to claim 5 wherein said workpiece is a semiconductor wafer.

7. An assembly according to claim 5 wherein said backing ring and said fulcrum impart substantially uniform vertical displacement on said wear element.

8. An assembly according to claim 7 wherein said first section and said second thicker section have a coplanar lower work surface and wherein said first section resides substantially adjacent said workpiece.

9. A wear ring assembly for use in a workpiece polishing apparatus, said assembly comprising:

a wear element;

a backing ring separate from said wear element and having a fulcrum thereon configured to transfer a component of pressure applied to said backing ring to said wear element via said fulcrum; and a clamp ring coupled to said backing ring for retaining said wear element.

10. An assembly according at claim 9 wherein said fulcrum imparts substantially uniform vertical displacement on said wear element.

11. An assembly according to claim 10 wherein said wear element is toroidal in shape having a first section and a second thicker section, said first and second sections having a coplanar work surface.

12. An assembly according to claim 11 wherein said workpiece is a semiconductor wafer.

13. A workpiece carrier for pressing a workpiece against a working surface, the carrier comprising:

a housing; and a wear ring configured to effect a substantial uniform vertical displacement of the working surface when the carrier urges the workpiece against the working surface, said wear ring comprising a wear ring element and a backing ring having a fulcrum thereon and configured to transfer a pressure applied to said backing ring to said wear element via said fulcrum.

14. A carrier according to claim 13 further comprising a clamp ring coupled to said housing and retaining said wear element.

15. A carrier according to claim 13 wherein said wear element and said backing ring are separate and engage each other only via said fulcrum.

16. A carrier according to claim 15 wherein said wear element is toroidal in shape having a first section and a second thicker section.

17. A carrier according to claim 16 wherein said pressure is applied via said fulcrum to said second thicker section.

18. A carrier according to claim 17 wherein said backing ring and said fulcrum impart substantially uniform vertical displacement onto said wear element.

19. An apparatus for polishing a semiconductor wafer, comprising:

a polishing pad;

a platen for supporting said polishing pad;

a wafer carrying head for placing said wafer into contact with said polishing pad causing said polishing pad to compress; and a wear ring assembly for compressing the polishing pad in a region substantially adjacent the wafer's edge, said assembly comprising:

a wear element; and a backing ring for applying a force on said wear element causing said wear element to engage said polishing pad, said backing ring having a pressure exerted thereon and having a fulcrum which engages said wear element, said backing ring rotating about said fulcrum as a result of said pressure and transmitting a vertical force onto said wear element via said fulcrum.

20. An apparatus according to claim 19 further comprising a clamp ring coupled to said backing ring for retaining said wear element.

21. An apparatus according to claim 20 wherein said wear element and said backing ring are separate and cooperate only via said fulcrum.

22. An apparatus according to claim 21 wherein said backing ring and said fulcrum impart substantially uniform vertical displacement on said wear element.

* * * * *